United States Patent [19]

Thau

[11] Patent Number: 4,875,726

[45] Date of Patent: Oct. 24, 1989

[54] COMPENSATING ESCUTCHEON PLATE FOR CAR DOOR

[75] Inventor: Wolfgang Thau, Concord, Canada

[73] Assignee: Magna International Inc., Markham, Canada

[21] Appl. No.: 122,133

[22] Filed: Nov. 17, 1987

[30] Foreign Application Priority Data

Dec. 3, 1986 [CA] Canada ..... 524487

[51] Int. Cl.[4] ..... E05C 21/00

[52] U.S. Cl. ..... 292/337; 292/DIG. 31; 292/DIG. 60; 292/DIG. 64

[58] Field of Search ..... 292/337, 347, DIG. 31, 292/DIG. 38, DIG. 60, DIG. 64, 357, 336.3, 216

[56] References Cited

U.S. PATENT DOCUMENTS

| | | | |
|---|---|---|---|
| 2,197,195 | 4/1940 | Schemers | 292/DIG. 31 X |
| 2,929,649 | 3/1960 | Coe | 292/357 X |
| 3,976,316 | 8/1976 | Laby | 292/251.5 |
| 4,038,718 | 8/1977 | Reilhac et al. | 292/DIG. 31 X |
| 4,343,501 | 8/1982 | Meeks | 292/DIG. 31 X |

*Primary Examiner*—Richard E. Moore

*Attorney, Agent, or Firm*—Ivor M. Hughes

[57] ABSTRACT

An escutcheon plate having a length, height and depth, the plate comprising a peripheral flange carrying an outer surface surrounding a central opening, the other side of the flange carrying a surface for engaging the material of the exterior door panel of a vehicle door surrounding the opening or aperture provided through the exterior door panel for access to the handle to open and close the door, at least three parallel rows of ridges, triangular in cross-section directed laterally of the escutcheon plate to permit an assembly carrying the handle to be secured thereto by at least three staggered rows of ridges triangular in cross-section and directed laterally to permit the meshing of the rows of ridges until the desired relative lateral positions of the components are reached at which point the escutcheon plate may be anchored relative to the assembly by a screw to the assembly for the handle and which intermeshed rows of ridges may only be joined or separated by moving them laterally towards or away from one another respectively and not towards or away from the outer peripheral surface and which rows may be secured together spacing the outer peripheral surface of the flange different distances from the handle and the assembly carrying the handle to permit the handle assembly to be secured at different distances from the exterior door panel.

12 Claims, 3 Drawing Sheets

COMPENSATING ESCUTCHEON PLATE FOR CAR DOOR

FIELD OF INVENTION

This invention relates to a compensating escutcheon plate for securing to the exterior door panel of a vehicle door surrounding the door handle for covering up (compensating for) irregularities in, changes in, and differences in the dimensions of the recess provided through the exterior door panel attached to the vehicle door and the handle assembly (mounted on the car door frame) accessed through the recess in the exterior door panel.

BACKGROUND OF THE INVENTION

Many proposals have been made to provide many prior manufactured sub-assemblies for fastening together at the time of assembly of a vehicle. These sub-assemblies are made according to specifications to be secured with other assemblies in the appropriate position in a vehicle. If one assembly is not manufactured correctly or if because of changes in temperature, their dimensions change, then the relative positioning of the elements may not be according to specification. This becomes critical when dealing with parts exposed to the environment. If because of irregularities in dimension, spaces occur between the sub-assemblies, when none should exist, then water may penetrate and damage the sub-assemblies or a burglar may penetrate through the opening and break into the vehicle. Furthermore, their appearance to a purchaser will be unsightly.

In this regard, with reference to the mounting of a handle to a car door for opening and closing the door, if the handle assembly is secured to the car door frame, and then the exterior door panels including an aperture therethrough for providing access to the handle is mounted on the frame, variations in the required dimensions of the components, may expose openings between the handle assembly and exterior door panel. Furthermore, where the exterior door panel comprises a plastics material, with exposure to heat and cold, there may be large fluctuations in the dimensions of the panel (contraction and expansion) exposing a space between the handle assembly and exterior door panel at the aperture provided for access to the handle.

It is therefore an object of this invention to provide an adjustable escutcheon plate suitable for use to overcome the aforementioned problems to ensure no space is visible when securing the exterior door panel to provide access to the handle through an aperture provided in the exterior door panel.

It is a further object of this invention to provide such adjustable escutcheon plate for being secured to the assembly supporting the handle to permit lateral adjustment of the assembly relative to the plate prior to securing the plate relative to the assembly and permit the escutcheon plate to be secured to the assembly at different positions spaced from the exterior skin to permit the handle to be mounted at a distance of "X" cm. from the exterior door panel in one vehicle, and in another vehicle "3/2X" cm. from the exterior door panel without unsightly openings appearing between the handle assembly and exterior door panel.

Further and other objects of the invention will be realized by those skilled in the art from the following summary of the invention and detailed description thereof.

SUMMARY OF INVENTION

According to one aspect of the invention, there is provided an adjustable escutcheon plate having a length, height and depth, the plate comprising a peripheral flange carrying an outer surface surrounding a central opening, the other side of the flange carrying a surface for engaging the material of the exterior door panel of a vehicle door surrounding the opening or aperture provided through the exterior door panel for access to the handle to open and close the door, fastening means in one embodiment, parallel rows of teeth or ridges (for example, at least three parallel rows of teeth or ridges triangular in cross-section) directed to extend laterally (lengthwise) of the escutcheon plate to permit an assembly carrying the handle to be secured thereto by complementary fastening means carried by the assembly, in one embodiment, parallel rows of teeth or ridges (for example, at least three rows of teeth triangular in cross-section) and directed laterally to permit the fastening means (and thus the escutcheon plate) to be brought from the side and meshed together with the complementary fastening means to mesh the complementary fastening means with the fastening means until the desired relative lateral (lengthwise) positions of the components are reached (at which point the escutcheon plate may be anchored relative to the assembly for example, by securing means secured to the assembly carrying the handle) (in one embodiment by a screw), and which fastening means and complementary fastening means may only be joined or separated by moving them laterally towards or away from one another respectively and not towards or away from the outer peripheral surface and which fastening means and complementary fastening means may be secured together spacing the outer peripheral surface of the flange different distances from the handle and the assembly carrying the handle to permit the handle assembly to be secured at different distances from the exterior door panel, thereby providing a compensating escutcheon plate to close any openings between the material surrounding the aperture provided in the exterior door panel through which access is provided to the handle and the assembly carrying the handle to compensate for the irregularities in the manufacture of the assembly and exterior door panel and changes caused by the environment in which the exterior door panel of the vehicle door is located (for example, contraction and expansion due to temperature changes).

According to another aspect of the invention, there is provided a compensating escutcheon plate assembly having length, height and depth, the compensating escutcheon plate assembly comprising a continuous peripheral annular flange having length and height and presenting an outer annular surface on one side and a back surface on the other side, the peripheral annular flange surrounding a central opening through the escutcheon plate, the flange having a continuous outer peripheral edge and a continuous inner peripheral edge surrounding the central opening, the back of the flange of engaging exterior door panel material of a vehicle door surrounding an opening in the panel provided through the exterior door panel for mounting a handle carrying assembly carrying a handle for opening and closing the door, formations carried on the compensating escutcheon plate assembly for positioning and fastening the compensating escutcheon plate assembly to complementary formations carried on the handle carrying assembly for causing the back surface of the peripheral flange to abut the exterior door panel material surrounding the opening through which the handle carrying assembly is mounted, the formations carried on the escutcheon plate assembly carrying means for engaging and being secured to complementary means carried on the complementary formations, said means being secureable together to permit the positioning of the length of the peripheral flange at different positions relative to the door handle assembly when the two are mounted together for use and to permit the escutcheon plate to be mounted at various depths relative to the handle assembly when the back surface of the peripheral flange engages the exterior door panel material thereby providing a compensating escutcheon plate to close any openings between the material surrounding the aperture provided in the exterior door panel through which access is provided to the handle and the assembly carrying the handle to compensate for the irregularities in the manufacture of the assembly and exterior door panel and changes caused by the environment in which the exterior door panel of the vehicle door is located (for example, contraction and expansion due to temperature changes).

According to another aspect of the invention, there is provided a compensating escutcheon plate assembly wherein the means and the complementary means on the formation and complementary formation respectively comprises longitudinally extending ridges extending in the same direction as the length of the compensating escutcheon plate assembly, the longitudinally extending ridges spaced by longitudinally extending depressions between the ridges for meshing with one another, at least one of said means and complementary means including one ridge, and the other at least two recesses.

According to another aspect of the invention, there is provided an escutcheon plate wherein one of the means or complementary means includes two longitudinally extending ridges and one depression therebetween and the other of the means or complementary means included a pair of longitudinally extending depressions and at least three longitudinally extending ridges.

According to still another aspect of the invention, there is provided an escutcheon plate wherein anchoring means are provided for securing the position of the compensating escutcheon plate relative to the handle carrying assembly.

Preferably, the outer peripheral surface carries behind it at three positions the fastening means and at the fourth corner a flange carrying a slot through which securing means (in one embodiment, a screw) may pass to be secured to the assembly for the handle (for example, into an aperture in a raised boss).

BRIEF DESCRIPTION OF THE DRAWINGS

The invention will now be illustrated with reference to the following drawings of an embodiment of the invention in which.

DESCRIPTION OF PREFERRED EMBODIMENTS OF THE INVENTION

Figure 1:
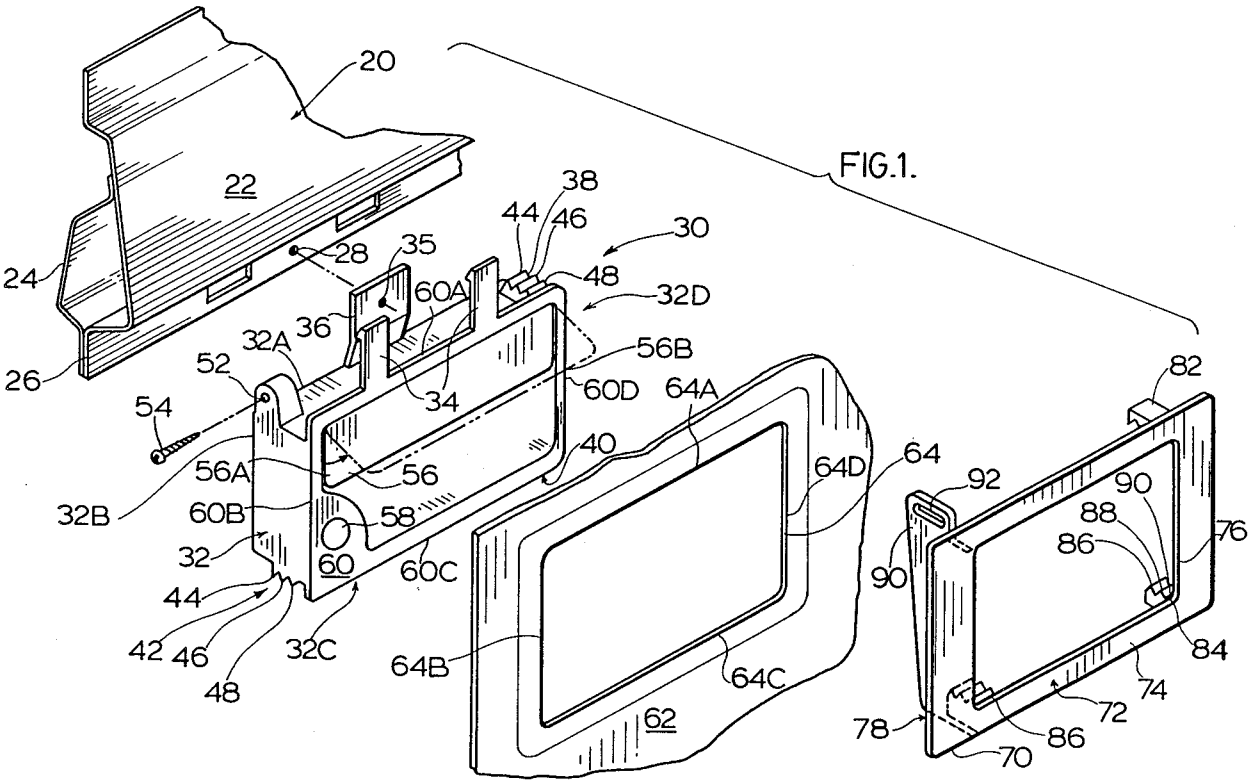
FIG. 1 is a perspective exploded view of an adjustable escutcheon plate constructed according to an embodiment of the invention used in a vehicle door to secure a handle assembly and exterior door panel.

With reference to FIG. 1, there is shown part of outer belt line reinforcement 20 of a car door (not shown) comprising sheets of metal 22 and 24 carrying mounting flange 26 carrying aperture 28 for mounting handle assembly 30 thereto. Assembly 30 comprising housing 32 is made up of rectangular frame members 32A, 32B, 32C and 32D. Supports 34 are provided for ease of assembly when securing assembly 30 to outer belt line reinforcement 20 by securing a fastener (not shown) through aperture 35 through upstanding flange 36 (carried at the back of top frame member 32A) into aperture 28.

On members 32A and 32C, fastening elements 38, 40 and 42 are provided, each comprising three parallel rows of triangular teeth or ridges 44, 46 and 48 the teeth or ridges of fastening elements 42 and 40 being aligned and directed towards one another (being parallel and co-aligned). Fastening element 40 is directly below fastening element 38. Instead of another fastening element aligned with element 38 on surface 32A, raised boss 50 is provided carrying bore hole 52 for receiving screw 54.

Housing 32 supports door handle 56 and key lock 58 in peripheral face 60. Handle 56 pivots upwardly from a vertical position 56A to generally horizontally extending position 56B for unlatching the door.

After housing 32 is mounted, exterior door panel 62 of plastics material is appropriately positioned carrying rectangular aperture 64 therethrough to provide access to the handle 56. The distance between outer edges 60A and 60C of face 60 is slightly less than the distance between peripheral edges 64A and 64C of aperture 64. The distance between peripheral edges 60D and 60B of face 60 is slightly less than the distance between edges 64D and 64B of recess 64 (The distances between 60A and 60C and 60B and 60D may have been greater than distance between 64A and 64C and 64B and 64D respectively, provided the corners of face 60 are reduced in size to permit escutcheon plate 70 to be secured to handle assembly 30 as shown in the drawings and hereinafter described).

Figure 3:
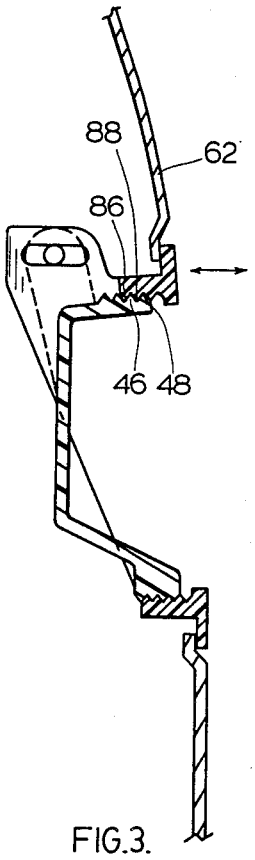
FIG. 3 is a side view of the escutcheon plate of FIG. 1 secured to the handle assembly spacing the handle assembly from the exterior door panel a greater distance than as shown in FIG. 2.

Escutcheon plate 70 comprises peripheral flange 72 comprising outer peripheral surface 74 surrounding central opening 76. On the back of flange 72 is surface 78 for abutting exterior door panel 62 (see FIG. 3). Supported on the back of flange 72 are three fastening elemental structures 80, 82 and 84, each comprising three parallel rows of triangular parallel teeth or ridges 86, 88, 90 for meshing with teeth or ridges 44, 46 and 48. Thus, the teeth or ridges 86, 88 and 90 are staggered to teeth or ridges 44, 46 and 48 to mesh. Flange 72 also carries flange 90 carrying slot 92 for receiving screw 54 for securing to aperture 52 of boss 50.

Figure 2:
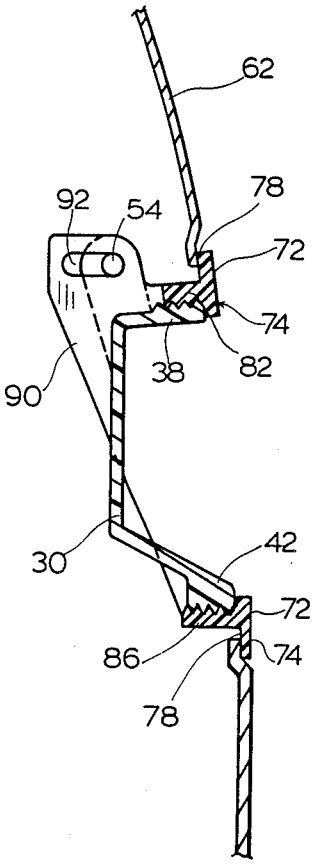
FIG. 2 is a side view of the escutcheon plate of FIG. 1, secured to a handle assembly spacing the handle assembly from the exterior door panel a shown distance.
Figure 4:
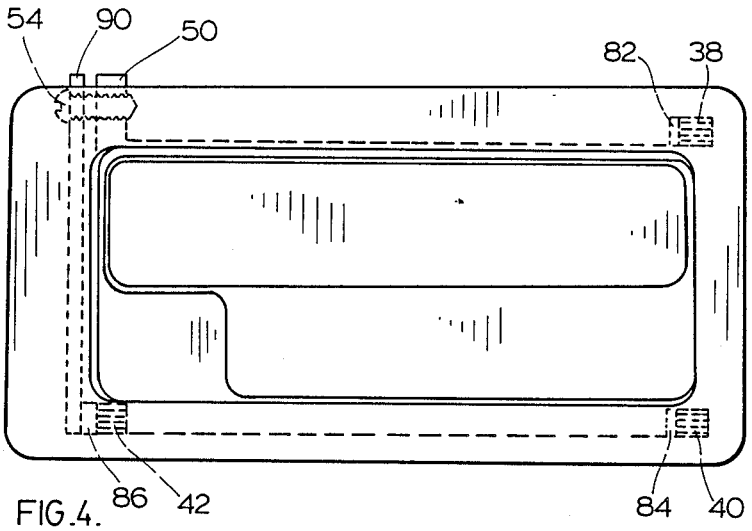
FIGS. 4 and 5 illustrate the escutcheon plate being secured to the assembly for the handle from the side and moved laterally and secured.
Figure 5:
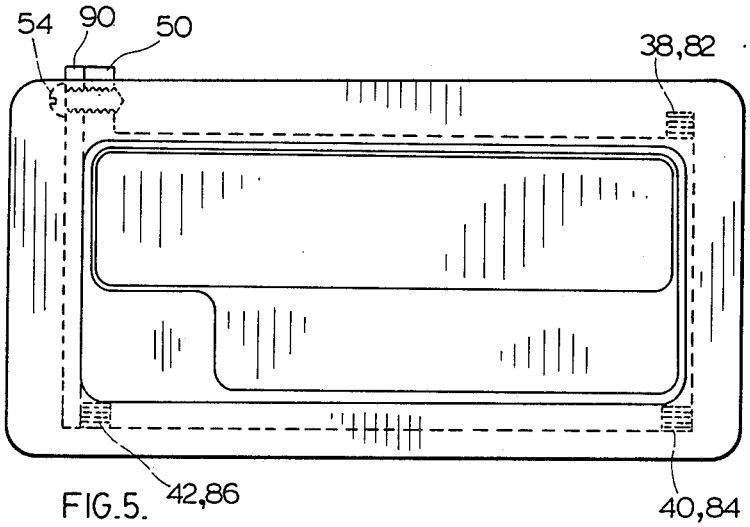

As is apparent from FIGS. 4 and 5, after housing 30 is secured to belt line reinforcement 20, and exterior door panel 62 is pushed towards housing 30, escutcheon plate 70 is pushed against panel 62 with flange 90 and each formation 82, 84 and 86 projecting through aperture 64. Escutcheon plate 70 is laterally slideable in aperture 64 but flange 72 constantly abuts the material of exterior panel 62 surrounding aperture 64. This lateral slideability of escutcheon plate 70 permits the formations 82, 84 and 86 and flange 90 to be positioned to the left of formations 38, 40 and 42 respectively, and slide laterally to the right intermeshing the formations and causing flange 90 to abut boss 50 which is thereafter tightly screwed thereto by screw 54 (which may be covered by a plastic cap [not shown]). The intermeshing is shown in FIG. 2. If it is desired to space (depthwise) exterior door panel 62 from housing 30, only some of the staggered teeth or ridges of each formation may be aligned laterally (see FIG. 3)—for example, teeth or ridges 86 and 88 with teeth or ridges 46 and 48—pushed together. As is apparent, tooth or ridges removal in the direction towards and away from flange 72 is not possible. Only by sliding laterally can the formations be detached. Further, as is apparent, escutcheon plate 70 compensates for irregularities and changes in the components because of a change in environment (for example, temperature).

As is also apparent, if the outer dimensions of 60A and 60C and 60B and 60D are larger than dimensions 64A and 64C and 64B and 64D, it is still possible to use escutcheon plate 70 to compensate as previously described provided the corners of housing 30 of face 60 proximate the formations 38, 40 and 42 and boss 50 are such as to permit the formations to be intermeshed. Thus, some material at the corners would have to be removed. However, in either case, the escutcheon plate's use is adjustable and compensates in use to close any openings between material surrounding aperture 64 provided through panel 62 through which access is provided to handle 56 and the assembly 30 carrying handle 56 to compensate for the irregularities in the manufacture of the assembly 30 and door panel 62 and changes caused by the environment in which the door panel is located (for example, expansion and contraction).

As many changes can be made to the embodiments of the invention without departing from the scope of the invention, it is intended that all material be interpreted as illustrative of the invention and not in a limiting sense.

The embodiments of the invention in which an exclusive property or privilege is claimed are as follows:

1. A compensating escutcheon plate assembly having length, height and depth, the compensating escutcheon plate assembly comprising a continuous peripheral annular flange presenting an outer annular surface on one side and a back surface on the other side, the peripheral annular flange surrounding a central opening through the escutcheon plate, the flange having a continuous outer peripheral edge and a continuous inner peripheral edge surrounding the central opening, the back of the flange for engaging exterior door panel material of a vehicle door surrounding an opening in the panel provided through the exterior door panel for mounting a handle carrying assembly carrying a handle for opening and closing the door, formations carried on the compensating escutcheon plate assembly for positioning and fastening the compensating escutcheon plate assembly to complementary formations carried on a handle carrying assembly for causing the back surface of the peripheral flange to abut an exterior door panel material surrounding the opening through which the handle carrying assembly is mounted, the formations carried on the escutcheon plate assembly carrying means for engaging and being secured to complementary means carried on the complementary formations, both said last aforementioned means being secureable together to permit the positioning of the length of the peripheral flange at different positions relative to the door handle assembly when the two are mounted together for use and to permit the escutcheon plate to be mounted at various depths relative to the handle assembly when the back surface of the peripheral flange engages the exterior door panel material thereby providing a compensating escutcheon plate to close any openings between the material surrounding the aperture provided in the exterior door panel through which access is provided to the handle and the assembly carrying the handle to compensate for the irregularities in the manufacture of the assembly and exterior door panel and changes caused by the environment in which the exterior door panel of the vehicle door is located (for example, contraction and expansion due to temperature changes).

2. The compensating escutcheon plate assembly of claim 1, wherein the means and the complementary means on the formation and complementary formation respectively comprises longitudinally extending ridges extending in the same direction as the length of the compensating escutcheon plate assembly, the longitudinally extending ridges spaced by longitudinally extending depressions between the ridges for meshing with one another, at least one of said means and complementary means comprising at least one ridge, and the other at least two recesses.

3. The escutcheon plate of claim 2, wherein the outer annular surface carries behind it at three positions the means and at a fourth position a flange carrying a slot through which securing means may pass to be secured to the handle carrying assembly for the handle.

4. The escutcheon plate of claim 1, wherein the means comprises parallel rows of ridges and the complementary means comprises staggered parallel rows of ridges for meshing with rows of ridges of the means.

5. The escutcheon plate of claim 4, wherein the rows of ridges of the means comprise at least three parallel rows of ridges triangular in cross-section.

6. An escutcheon plate having a length, height and depth, the plate comprising a peripheral flange carrying an outer surface surrounding a central opening, the other side of the flange carrying a surface for engaging the material of an exterior door panel of a vehicle door surrounding the opening or aperture provided through the exterior door panel for access to a door handle to open and close the door, the escutcheon plate also carrying at least three parallel rows of ridges, each of the ridges in each of the rows being triangular in cross-section, extending parallel to the ridges in each of the formations and extending parallel to the length of the escutcheon plate to permit an assembly carrying a handle to be secured to the escutcheon plate by at least three parallel rows of ridges, triangular in cross-section, and extending parallel to the ridges on the escutcheon plate to permit the meshing of the rows of ridges until the desired relative position of the escutcheon plate relative to the handle assembly is reached at which point the escutcheon plate may be anchored relative to the assembly by a screw passing into the assembly for the handle, whereby the intermeshed rows of ridges may only be joined or separated by moving them lengthwise towards or away from one another respectively and not depthwise towards or away from the outer peripheral surface and which rows may be secured together spacing the outer peripheral surface of the flange different distances from the handle and the assembly carrying the handle to permit the handle assembly to be secured at different distances from the exterior door panel, thereby providing a compensating escutcheon plate to close any openings between the material surrounding the aperture provided in the exterior door panel through which access is provided to the handle and the assembly carrying the handle to compensate for the irregularities in the manufacture of the assembly and exterior door panel and changes caused by the environment in which the exterior door panel of the vehicle door is located.

7. In combination, a door handle and assembly for unlatching a door, an exterior door panel of a vehicle door and having an opening through which the door handle and assembly is secured, and an escutcheon plate having a length, height and depth, the plate comprising a peripheral flange carrying an outer surface surrounding a central opening, the other side of the flange carrying a surface engaging the material of the exterior door panel of said vehicle door surrounding the opening or aperture provided through the exterior door panel for access to the handle to open and close the door, fastening means directed laterally (lengthwise) of the escutcheon plate to permit the assembly carrying the handle to be secured thereto by complementary fastening means carried by the assembly and directed laterally to permit the fastening means to be brought from the side and meshed together with the complementary fastening means to mesh and the complementary fastening means with the fastening means until the desired relative lateral (lengthwise) positions of the components are reached at which point the escutcheon plate may be anchored relative to the assembly and which fastening means and complementary fastening means may only be joined or separated by moving them laterally towards or away from one another respectively and not towards or away from the outer peripheral surface and which fastening means and complementary fastening means may be secured together spacing the outer peripheral surface of the flange different distances from the handle and the assembly carrying the handle to permit the handle assembly to be secured at different distances from the exterior door panel, thereby providing a compensating escutcheon plate to close any openings between the material surrounding the aperture provided in the exterior door panel through which access is provided to the handle and the assembly carrying the handle to compensate for the irregularities in the manufacture of the assembly and exterior door panel and changes caused by the environment in which the exterior door panel of the vehicle door is located (for example, contraction and expansion due to temperature changes).

8. The combination of claim 7, wherein the outer peripheral surface carries behind it at three positions the fastening means and at a fourth position a flange carrying a slot through which securing means may pass to be secured to the assembly for the handle.

9. The combination of claim 7, wherein the fastening means comprises parallel rows of ridges and the complementary fastening means comprises staggered parallel rows of ridges for nesting with rows of teeth of the fastening means.

10. The combination of claim 9, wherein the rows of ridges of the fastening means comprise at least three rows of ridges triangular in cross-section.

11. The escutcheon plate of claim 2, wherein one of the means or complementary means comprises at least two longitudinally extending ridges and one depression therebetween and the other of the means or complementary means comprises at least a pair of longitudinally extending depressions and at least three longitudinally extending ridges.

12. The escutcheon plate of claim 1, wherein anchoring means are provided for securing the position of the compensating escutcheon plate relative to the handle carrying assembly.

* * * * *